United States Patent [19]

Weber et al.

[11] Patent Number: 5,019,228

[45] Date of Patent: May 28, 1991

[54] ELECTROPOLISHING METHOD FOR DECONTAMINATION PURPOSES

[75] Inventors: Robert Weber, Uttenreuth; Hubert Stamm, Nurrmberg, both of Fed. Rep. of Germany

[73] Assignee: Siemens Aktiengesellschaft, Munich, Fed. Rep. of Germany

[21] Appl. No.: 387,069

[22] Filed: Jul. 28, 1989

[30] Foreign Application Priority Data

Jul. 28, 1988 [DE] Fed. Rep. of Germany ..... 3825708

[51] Int. Cl.[5] ..... C25F 3/16

[52] U.S. Cl. ..... 204;129.75; 204/140

[58] Field of Search ..... 204/129.75, 130, 140

[56] References Cited

U.S. PATENT DOCUMENTS

| | | | |
|---|---|---|---|
| 2,506,582 | 5/1950 | Der Mateosian | 204/129.85 |
| 4,828,759 | 5/1989 | Hanulik | 204/140 |
| 4,836,900 | 6/1989 | Bellanger | 204/140 |

FOREIGN PATENT DOCUMENTS

| | | |
|---|---|---|
| 2756145 | 6/1979 | Fed. Rep. of Germany . |
| 3343396 | 6/1985 | Fed. Rep. of Germany . |
| 3345278 | 6/1985 | Fed. Rep. of Germany . |
| 216051 | 11/1984 | German Democratic Rep. . |

OTHER PUBLICATIONS

Publication Metal Finishing Abstracts, vol. 17, No. 6; Nov./Dec. 1975, Page 345C (B. P. Konstantinov Inst. Nuclear Foz, Leningrad).

*Primary Examiner*—T. M. Tufariello

*Attorney, Agent, or Firm*—Herbert L. Lerner; Laurence A. Greenberg

[57] ABSTRACT

An electropolishing method for decontaminating component parts in nuclear facilities includes enriching deionized water with an electrolyte that can be processed by a water processing plant present in the nuclear facility in order to assure electrical conductivity, and electropolishing with the deionized water.

10 Claims, No Drawings

ELECTROPOLISHING METHOD FOR DECONTAMINATION PURPOSES

The invention relates to an electropolishing method for decontaminating component parts in nuclear facilities.

During the operation of nuclear facilities, contamination of component parts that come into contact with radioactive substances, such as conduits, vessels, shafts and the like, is usually unavoidable. The contamination is due very predominantly to the deposit of radioactive isotopes on the surfaces of these component parts. In order to decontaminate the component parts, electropolishing methods have thus far proved useful, such as those known, for instance, from German Published, Non-Prosecuted Patent Applications DE-OS 33 43 396, corresponding to U.S. Pat. No. 4,632,740 and DE-OS 33 45 278, corresponding to U.S. Pat. No. 4,634,511. In most of these electropolishing methods, the component part having a surface which is to be decontaminated is connected as an anode, with a sponge electrode as the cathode. The conductive connection between the cathode and the anode is established by means of deionized water, with which an electrolyte is mixed to assure a sufficiently high conductivity. In most cases, dilute sulfuric acid or dilute phosphoric acid is used for this purpose. With the voltage switched on, the sponge electrode is wiped over the surface to be decontaminated. In this method, a very thin surface layer having the contamination deposited thereon is removed, and the removed material is floated away with the electrolyte solution formed of deionized water and electrolyte. Experience has shown that through the use of this means alone, the radioactivity of contaminated surfaces can be reduced by more than a power of ten.

After the decontamination, the acid used in the decontamination contains radioactive residues from the material removed and must therefore be disposed of in an expensive manner. The expense for disposal is considerable both in terms of monetary cost and in terms of protection of human beings. The acid solutions that remain after the decontamination are collected in special containers and transported to processing plants. In the factory and during transportation, special shielding provisions are necessary, so that the emission of radioactivity into the environment is reduced to the permissible level.

At the same time, care must be taken during the decontamination to avoid leakage as much as possible, in order to avoid contaminating adjacent areas of the plant. Particularly in decontamination in primary loops of power plants, entire sections of conduit must be carefully sealed off. Unavoidable leakage into a conduit connected to the component to be decontaminated necessitates careful removal of the escaped liquid by suction. This additional work increases the radiation exposure to human beings and at the same time increases both the technical risk and the cost.

It is accordingly an object of the invention to provide an electropolishing method for decontamination purposes, which overcomes the hereinafore-mentioned disadvantages of the heretofore-known methods of this general type, which reduces the radiation exposure to human beings during the decontamination of component parts on one hand, and which reduces the technical effort and financial expense for such provisions on the other hand.

With the foregoing and other objects in view there is provided, in accordance with the invention, an electropolishing method for decontaminating component parts in nuclear facilities, which comprises enriching deionized water with an electrolyte that can be processed by a water processing plant present in and belonging to the nuclear facility itself in order to assure electrical conductivity, and electropolishing with the deionized water.

Due to the use of deionized water which was enriched with electrolytes that can be reprocessed by the facility's own water processing plant, the solution that remains after the decontamination need no longer be carried away in shielded containers but instead can be processed by the facilities own water purification or processing plant. The salts produced in this process can be filtered out. In the case of leakage the component to be decontaminated into other component parts, for example into a conduit connected to it, it is also possible to dispense with a special removal operation by suction of the escaped fluid. Without additional provisions being made, this fluid flows from there to the facility's own water processing system, where it is processed. This considerably reduces the radiation exposure of the staff.

In accordance with another mode of the invention, there is provided a method which comprises adding an electrolyte already present in the primary coolant of a nuclear power plant to the deionized water during the enriching step. As a result, damage to material from electrolyte residues remaining in adjoining component parts is reliably avoided, because the electrolytes which are used are already present in the primary coolant, and the materials which are used are selected for these electrolytes.

In accordance with a further mode of the invention, there is provided a method which comprises adding boric acid or lithium hydroxide to the deionized water.

In accordance with an added mode of the invention, there is provided a method which comprises increasing the temperature of the deionized water enriched with electrolyte past the ambient temperature, in order to increase its conductivity. The increased conductivity improves the outcome of the decontamination.

In accordance with a concomitant mode of the invention, there is provided a method which comprises placing a sponge electrode less than 10 mm from the surface to be treated, and electropolishing with the sponge electrode. Virtually complete decontamination is thus attained.

Other features which are considered as characteristic for the invention are set forth in the appended claims.

Although the invention is illustrated and described herein as embodied in an electropolishing method for decontamination purposes, it is nevertheless not intended to be limited to the details given, since various modifications may be made therein without departing from the spirit of the invention and within the scope and range of equivalents of the claims.

The method of operation of the invention, however, together with additional objects and advantages thereof will be best understood from the following description of specific embodiments.

Referring now to an embodiment of the invention in detail, if the inner wall surface of a pressure line in the primary loop of a nuclear reactor, for instance, is to be decontaminated in order to perform maintenance work, then an electropolishing apparatus such as that disclosed in German Published, Non-Prosecuted Patent Application DE-OS 33 45 278, corresponding to U.S. Pat. No. 4,634,511, can be used. However, according to the method of the invention, deionized water to which boric acid has previously been added is used instead of the electrolyte solution used in the lastmentioned references, which is usually dilute sulfuric acid. Since the electrical conductivity that can be attained with boric acid is markedly less than the conductivity that can be attained with sulfuric acid, the flow rate and therefore the removal of material per unit of time will also be less. In order to compensate for this reduced output, the deionized water enriched with boric acid and supplied to the sponge electrode can be heated prior to being introduced into the sponge electrode. The limiting temperature to be adhered to in this case is limited by the temperature resistance of the sponge and other components of the sponge electrode and by steam production. Temperatures of approximately 75° C. for the deionized water enriched with boric acid are realistic, if suitably temperature-proof sponges are used. Furthermore, in order to increase the amount removed per unit time, the thickness of the sponge used, or in other words the distance between the metal part of the sponge electrode and the surface to be decontaminated, can be decreased. In this case, sponge thicknesses of 10 mm and less, preferably 5 mm, can readily be used.

The operation of the electropolishing apparatus can be carried out in the conventional manner, as described in German Published, Non-Prosecuted Patent Applications DE-OS 33 45 278, corresponding to U.S. Pat. No. 4,634,511 and DE-OS 33 43 396, corresponding to U.S. Pat. No. 4,632,740. In a plant, however, it is suitable to connect a heater for heating the electrolyte solution to the supply line leading to the sponge electrode. Once the electropolishing work has been completed, the deionized water enriched with boric acid is located in a collecting vessel for the electrolyte solution together with the surface substances removed, including the radioactive material originally deposited on the surface. Moreover, the interior of the tube or vessel so treated is contaminated with small quantities of remaining electrolyte solution. Since these remaining quantities of electrolyte solution are substantially composed of the deionized water and boric acid which are present in any case in the primary loop and are vanishingly small in quantity as compared with the quantity of deionized water to be used in operation, the nuclear power plant can be put back into operation after the decontamination without having to tediously remove the remaining quantity of electrolyte solution by suction. The slight increase in the boric acid content in the coolant that results is readily processable by the facility's own water processing plant. As a result, the use of humans to effect the removal by suction, which is otherwise required, becomes unnecessary. After filtering out the removal material, the quantity of electrolyte solution in the collecting vessel can also be supplied gradually to the facility's own water processing plant, processed there, and supplied to the primary coolant.

A great advantage of this type of decontamination is that the removal by suction of escaping fluid due to unavoidable leakage, which increases the radiation exposure to human beings and is labor-intensive, need not be done. Moreover, the removal of the quantities of electrolyte solution which are consumed to a location outside the nuclear power plant, can be dispensed with. Finally, another advantage of this method is that the processing of the electrolyte solution after the decontamination can be performed by the facility's own water processing plant. It should not be forgotten that after the processing of the solution, the major part, namely the deionized water, can be re-used. Only a very small sludge-like residue needs to be disposed of, as is done from time to time with the residues from the water purification process performed in the course of plant operation.

I claim:

1. Electropolishing method for decontaminating component parts in nuclear facilities, which comprises enriching deionized water with an electrolyte that can be processed by a water processing plant present in the nuclear facility, the deionized water being enriched with the electrolyte to form an electrolyte solution in order to assure electrical conductivity, electropolishing with the electrolyte solution, removing removal material from the electrolyte solution, and supplying the remaining electrolyte solution to the facility's own water processing plant for processing.

2. Method according to claim 1, which comprises adding an electrolyte, which is already present in the primary coolant of a nuclear power plant, to the deionized water during the enriching step.

3. Method according to claim 2, which comprises adding boric acid to the deionized water.

4. Method according to claim 2, which comprises adding lithium hydroxide to the deionized water.

5. Method according to claim 3, which comprises adding lithium hydroxide to the deionized water.

6. Method according to claim 1, which comprises increasing the temperature of the deionized water enriched with electrolyte past the ambient temperature, in order to increase its conductivity.

7. Method according to claim 1, which comprises placing a sponge electrode less than 10 mm from the surface to be treated, and electropolishing with the sponge electrode.

8. Electropolishing method for decontaminating component parts in a nuclear facility having a water processing plant, which comprises:

forming an electrolyte solution for assuring electrical conductivity by enriching deionized water with an electrolyte that can be processed by the water processing plant, electropolishing with the electrolyte solution for removing surface material from the component parts, cleaning the electrolyte solution by removing removal material therefrom, and supplying the cleaned electrolyte solution to the water processing plant of the nuclear facility.

9. The method according to claim 8, wherein the cleaning step comprises filtering the removal parts from the electrolyte solution.

10. The method according to claim 8, which further comprises processing the electrolyte solution in the water processing plant.

* * * * *